US009546483B2

(12) United States Patent
Gosling et al.

(10) Patent No.: US 9,546,483 B2
(45) Date of Patent: Jan. 17, 2017

(54) MODULAR WALLS WITH SEISMIC-SHIFTABILITY

(71) Applicant: DIRTT Environmental Solutions, Ltd., Calgary (CA)

(72) Inventors: Geoff Gosling, Calgary (CA); Mogens F. Smed, DeWinton (CA)

(73) Assignee: DIRTT Environmental Solutions, LTD., Calgary (CA)

( * ) Notice: Subject to any disclaimer, the term of this patent is extended or adjusted under 35 U.S.C. 154(b) by 0 days.

(21) Appl. No.: 14/114,501

(22) PCT Filed: Oct. 4, 2013

(86) PCT No.: PCT/US2013/063580
§ 371 (c)(1),
(2) Date: Oct. 28, 2013

(87) PCT Pub. No.: WO2014/055950
PCT Pub. Date: Apr. 10, 2014

(65) Prior Publication Data

US 2015/0211229 A1 Jul. 30, 2015

Related U.S. Application Data

(60) Provisional application No. 61/710,549, filed on Oct. 5, 2012.

(51) Int. Cl.
*E04B 1/32* (2006.01)
*E04B 2/74* (2006.01)
(Continued)

(52) U.S. Cl.
CPC ..... *E04B 2/7448* (2013.01); *E04B 2/7453* (2013.01); *E04B 2/76* (2013.01); *E04C 2/405* (2013.01);
(Continued)

(58) Field of Classification Search
CPC ..... E04B 1/32; E04B 2001/3235; E04B 2001/3241; E04B 2001/3247; E04B 2001/327; E04B 1/34357; E04B 1/34363; E04B 1/34384; E04B 2/7748; E04B 2/7453; E04B 2/82; E04B 2/3441; E04C 2/405; E04C 2/46; E04C 2/48
(Continued)

(56) References Cited

U.S. PATENT DOCUMENTS

D26,071 S 9/1896 Howland
1,715,853 A * 6/1929 Madsen ..... 52/64
(Continued)

FOREIGN PATENT DOCUMENTS

DE 2802151 7/1979
EP 1712694 10/2006
(Continued)

OTHER PUBLICATIONS

International Search Report and Written Opinion for PCT/US2013/063580 mailed Oct. 4, 2013.
(Continued)

*Primary Examiner* — Phi A
(74) *Attorney, Agent, or Firm* — Workman Nydegger

(57) ABSTRACT

Implementations of the present invention relate to systems, methods, and apparatus for providing components of a wall module and a modular wall with the ability to shift or move relative to each other. The ability to shift can reduce or prevent damage to the wall modules during movement of support structures (ceilings, floors, permanent or structural walls) that secure the wall modules, which can shift or move relative to each other during seismic events or otherwise.

20 Claims, 6 Drawing Sheets

(51) Int. Cl.

| | |
|---|---|
| ***E04B 2/76*** | (2006.01) |
| ***E04C 2/40*** | (2006.01) |
| ***E04B 2/00*** | (2006.01) |
| *E04B 2/82* | (2006.01) |
| *E04B 1/344* | (2006.01) |

(52) U.S. Cl.
CPC . *E04C 2/46* (2013.01); *E04C 2/48* (2013.01); *E04B 1/3441* (2013.01); *E04B 2/82* (2013.01)

(58) Field of Classification Search
USPC .... 52/238.1, 243, 243.1, 79.5, 167.1, 167.4, 52/72, 64, 36.1
See application file for complete search history.

(56) References Cited

U.S. PATENT DOCUMENTS

| | | | | |
|---|---|---|---|---|
| D172,998 | S | 9/1954 | Sumner | |
| 2,996,157 | A * | 8/1961 | Rauth | 52/64 |
| 3,159,236 | A | 12/1964 | Akerson | |
| 3,174,580 | A | 3/1965 | Schulz | |
| 3,177,970 | A | 4/1965 | Boschi | |
| D204,057 | S | 3/1966 | Logan | |
| 3,358,411 | A | 12/1967 | Birum | |
| 3,526,065 | A * | 9/1970 | Lee | 451/490 |
| 3,526,066 | A * | 9/1970 | Gamble | E04B 1/3444 52/109 |
| 3,770,560 | A | 11/1973 | Elder | |
| 4,076,100 | A | 2/1978 | Davis | |
| 4,084,367 | A | 4/1978 | Saylor | |
| 4,269,005 | A | 5/1981 | Timmons | |
| 4,417,426 | A * | 11/1983 | Meng | 52/126.7 |
| 4,535,577 | A | 8/1985 | Tenser | |
| 4,546,591 | A | 10/1985 | Beltz | |
| 4,555,889 | A | 12/1985 | Mankowski | |
| 4,708,189 | A | 11/1987 | Ward | |
| D300,803 | S | 4/1989 | Whitley | |
| 4,844,109 | A * | 7/1989 | Navarro | E04H 15/505 135/129 |
| D306,689 | S | 3/1990 | Hamann | |
| 4,914,873 | A | 4/1990 | Newhouse | |
| D313,933 | S | 1/1991 | Petley | |
| 5,024,030 | A | 6/1991 | Morrison | |
| 5,050,353 | A * | 9/1991 | Rogers et al. | 52/8 |
| 5,134,826 | A | 8/1992 | La Roche | |
| 5,155,955 | A | 10/1992 | Ball | |
| 5,172,530 | A | 12/1992 | Fishel | |
| 5,195,286 | A | 3/1993 | DeLong | |
| 5,297,368 | A * | 3/1994 | Okada | 52/64 |
| D348,384 | S | 7/1994 | Karsten | |
| 5,349,794 | A * | 9/1994 | Taga | 52/167.1 |
| 5,487,402 | A | 1/1996 | Clary | |
| 5,642,593 | A | 7/1997 | Shieh | |
| 5,732,802 | A * | 3/1998 | Tsukagoshi | 188/378 |
| 5,735,100 | A | 4/1998 | Campbell | |
| 5,852,904 | A | 12/1998 | Yu | |
| 5,906,080 | A | 5/1999 | Digirolamo | |
| 5,934,028 | A * | 8/1999 | Taylor | 52/167.3 |
| D429,998 | S | 8/2000 | Snell | |
| 6,170,202 | B1 * | 1/2001 | Davoodi et al. | 52/167.1 |
| 6,260,324 | B1 | 7/2001 | Miedema | |
| 6,351,917 | B1 | 3/2002 | MacDonald | |
| 6,434,895 | B1 * | 8/2002 | Hosterman et al. | 52/143 |
| 6,502,357 | B1 | 1/2003 | Stuthman | |
| 6,598,351 | B2 * | 7/2003 | Hallberg | 52/9 |
| 6,679,016 | B2 * | 1/2004 | Liu | 52/238.1 |
| 6,889,477 | B1 | 5/2005 | Kottman | |
| 7,226,033 | B2 * | 6/2007 | Foucher et al. | 249/44 |
| D569,713 | S | 5/2008 | Sandidge | |
| D576,475 | S | 9/2008 | Didehvar | |
| 7,466,286 | B2 * | 12/2008 | Chapman | 343/890 |
| 7,712,260 | B2 * | 5/2010 | Vardaro et al. | 52/36.1 |
| 7,797,901 | B2 * | 9/2010 | Near | 52/481.1 |
| 7,926,430 | B2 | 4/2011 | Bakker | |
| 7,958,683 | B2 | 6/2011 | Abusada | |
| 8,015,767 | B2 | 9/2011 | Glick | |
| 8,033,059 | B2 | 10/2011 | Contois | |
| 8,046,957 | B2 | 11/2011 | Towersey | |
| D696,572 | S | 12/2013 | Petruccelli | |
| 8,601,749 | B2 | 12/2013 | Von Hoyningen Huene et al. | |
| 8,613,168 | B2 | 12/2013 | Von Hoyningen Huene et al. | |
| 8,615,936 | B2 | 12/2013 | Von Hoyningen Huene et al. | |
| D699,547 | S | 2/2014 | Syed et al. | |
| 8,813,455 | B2 * | 8/2014 | Merrifield | 52/646 |
| 8,899,519 | B2 | 12/2014 | Smith | |
| 2001/0009218 | A1 | 7/2001 | Emaus | |
| 2003/0154672 | A1 | 8/2003 | Spransy | |
| 2004/0226259 | A1 | 11/2004 | Barnet | |
| 2006/0057345 | A1 | 3/2006 | Surace et al. | |
| 2006/0059806 | A1 | 3/2006 | Gosling | |
| 2006/0157297 | A1 | 7/2006 | D'Antonio | |
| 2007/0186493 | A1 | 8/2007 | Baig | |
| 2008/0302054 | A1 | 12/2008 | Gosling | |
| 2011/0100749 | A1 | 5/2011 | Nonogi | |
| 2011/0146180 | A1 | 6/2011 | Klein | |
| 2011/0147119 | A1 | 6/2011 | Cao | |
| 2013/0118831 | A1 | 5/2013 | Kawai | |
| 2014/0157720 | A1 | 6/2014 | Von Hoyningen Huene et al. | |

FOREIGN PATENT DOCUMENTS

| | | |
|---|---|---|
| JP | 02164984 | 6/1990 |
| JP | 0925621 | 9/1997 |
| JP | 11013176 | 1/1999 |
| JP | 11050574 | 2/1999 |
| JP | 2003172041 | 6/2003 |
| KR | 20020037255 | 5/2002 |
| KR | 1020020037255 | 5/2002 |
| KR | 101143844 | 5/2012 |
| WO | 2012008225 | 1/2012 |
| WO | 2012094766 | 7/2012 |

OTHER PUBLICATIONS

International Search Report and Written Opinion for PCT/US2013/063548 mailed Jan. 16, 2014.
Office Action for U.S. Appl. No. 14/114,019 mailed Aug. 7, 2015.
International Search Report and Written Opinion for PCT/US2013/063488 mailed Jan. 17, 2014.
Office Action for U.S. Appl. No. 29/473,239 mailed May 5, 2015.
Non-Final Office Action for U.S. Appl. No. 14/722,642 mailed on Nov. 19, 2015.
Non-Final Office Action for U.S. Appl. No. 14/113,252 mailed on Nov. 9, 2015.
European Search Report for U.S. Appl. No. 13/844,034 mailed on Sep. 7, 2016.
Non-Final Office Actions for U.S. Appl. No. 14/722,642 mailed on Aug. 8, 2016.
European Search Report for U.S. Appl. No. 13/843,375 mailed on Sep. 9, 2016.
International Search Report and Written Opinion for Application No. EP 13843993 mailed May 30, 2016.

* cited by examiner

MODULAR WALLS WITH SEISMIC-SHIFTABILITY

CROSS-REFERENCE TO RELATED APPLICATIONS

The present application is a 35 U.S.C. §371 U.S. National Stage of PCT Application No. PCT/US2013/063580 entitled "Modular Walls With Seismic-Shiftability" filed Oct. 4, 2013, which claims the benefit of priority to U.S. Provisional Patent Application No. 61/710,549, filed Oct. 5, 2012, entitled "Modular Walls with Seismic-Shiftability." The entire content of each aforementioned patent application is incorporated herein by reference.

BACKGROUND OF THE INVENTION

1. The Field of the Invention

This invention generally relates to modular wall systems and methods of installing such systems. More specifically, the present invention relates to modular walls with components capable of shifting relative to each other.

2. Background and Relevant Art

Office space can be relatively expensive due to the basic costs of the location and size of the office space. In addition to these costs, an organization may incur further expense configuring the office space in a desirable layout. An organization might purchase or rent a large open space in a building, and then subdivide or partition the open space into various offices, conference rooms, or cubicles. Rather than having to find new office space and move as an organization's needs change, it is often desirable to reconfigure the existing office space. Many organizations address their configuration and reconfiguration issues by dividing large, open office spaces into individual work areas using modular wall segments (or wall modules) and partitions.

In particular, at least one advantage of modular wall systems is that they are relatively easy to configure. In addition, modular wall systems can be less expensive to set up and can allow for reconfiguration more easily than more permanently constructed walls. For example, an organization can construct a set of offices and a conference area within a larger space in a relatively short period of time with the use of modular wall systems. If office space needs change, the organization can readily reconfigure the space.

In general, modular office partitions typically include a series of individual wall modules. The individual wall modules are typically free-standing or rigidly attached to one or more support structures. In particular, a manufacturer or assembler can usually align and join the various wall modules together to form an office, a room, a hallway, or otherwise divide an open space.

While conventional modular wall systems can provide various advantages, such as those described above, conventional modular wall systems suffer from a number of drawbacks. For example, conventional modular wall systems are typically rigid and lack the ability to compensate for movement of the support surfaces to which they are attached. Some buildings, such as high-rise buildings, can sway and move, thereby causing relative motion between floors of the building. Similarly, buildings located in seismically active areas can (from time to time) experience seismic events (such as earthquakes), which can cause relative movement between the building's floors.

Consequently, such relative movement can stress, damage, and/or break the rigidly connected modular walls. Furthermore, movement of the walls can cause damage to connected surfaces, such as floors or ceilings. Alternatively, modular walls lacking adequate strength or stability can fall during such movement. One will appreciate that in either case, the falling or breaking of wall modules during a seismic event can cause significant damage and injury both to the wall modules and individuals working near the wall modules.

Furthermore, the forgoing problems are often exacerbated with wider walls. In particular, wider walls often have more connections to support structures, more mass, and more depth. Thus, movement due to seismic events can be particularly damaging when wider walls are involved.

Accordingly, there are a number of disadvantages with conventional wall systems that can be addressed.

BRIEF SUMMARY OF THE INVENTION

Implementations of the present invention include systems, methods, and apparatus for providing components of a wall module and a modular wall with the ability to shift or move relative to each other. The ability to shift can reduce or prevent damage to the wall modules during movement of support structures (ceilings, floors, permanent or structural walls) that secure the wall modules, which can shift or move relative to each other during seismic events or otherwise. In particular, at least one implementation includes a wall module having multiple module or frame sections (e.g., outer sections) connected together by pivoting brackets to form a single wall module. The pivoting brackets can allow the frame sections to shift or otherwise move relative to each other, while still providing adequate structural strength and rigidity under normal operating conditions, absent a seismic event.

In one implementation, a shiftable frame for accommodating movement of structural portions of a building is provided. The shiftable frame includes a first frame section having a plurality of first vertical supports and one or more first horizontal supports. The shiftable frame also includes a second frame section having a plurality of second vertical supports and one or more second horizontal supports. Furthermore, the shiftable frame includes one or more brackets. Each of the one or more brackets has a first end pivotally connected to the first frame section and a second end pivotally connected to the second frame section. One or more of the first frame section and the second frame section includes connection features connectable to corresponding features of a panel.

In another implementation, a shiftable wall module for at least partially defining one or more individual spaces within a building is provided. The shiftable wall module includes a first frame section, a second frame section, a bracket, and at least one panel. The first frame section includes a first vertical support and a first stringer. The second frame section includes a second vertical support. The bracket is pivotally connected to the first vertical support and the second vertical support in a manner that the first frame section and the second frame section are movable relative to each other. The at least one panel is removably connected to the stringer.

According to another implementation, a method of installing a wall module in a building includes positioning a bottom end of a first frame section of a frame on a floor of the building and tilting the frame toward an upright orientation. The installation method also includes pressing a second section of the frame (that is movably connected to the first section) against the floor, moving the second section in a direction generally parallel to the first section, and positioning the frame in the upright orientation.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention include systems, methods, and apparatus for providing components of a wall module and a modular wall with the ability to shift or move relative to each other. The ability to shift can reduce or prevent damage to the wall modules during movement of support structures (ceilings, floors, permanent or structural walls) that secure the wall modules, which can shift or move relative to each other during seismic events or otherwise. In particular, at least one implementation includes a wall module having multiple module or frame sections (e.g., outer sections) connected together by pivoting brackets to form a single wall module. The pivoting brackets can allow the frame sections to shift or otherwise move relative to each other, while still providing adequate structural strength and rigidity under normal operating conditions, absent a seismic event.

For example, pivoting brackets can form flexible or movable connections between two module sections of the wall module. Each module section of the wall module also can connect to the ceiling and/or floor of the building independent of other module sections. During a seismic event, the ceiling and floor of a building can move relative to each other. Hence, flexible or movable connections between the module sections of the wall module can allow the module sections to shift or otherwise move relative to each other, which can minimize, prevent, or eliminate damage during the seismic event.

Additionally, movable connections between the module sections can facilitate installation of the wall module. In particular, implementations can include wall modules that have approximately the same height as the distance between the floor and ceiling at the installation site. In other words, the installer can position the bottom end of the wall module on the floor and the top end of the wall module near the ceiling. Accordingly, to facilitate installation of the wall module, the installer can collapse the wall module by bringing adjacent module sections together and thereby reducing the thickness of the wall module. After positioning the bottom end of a first module section on the floor, the installer can tilt the wall module toward the ceiling and, subsequently, expand the wall module to full width, thereby positioning the wall module in proximity with the ceiling.

Figure 1:
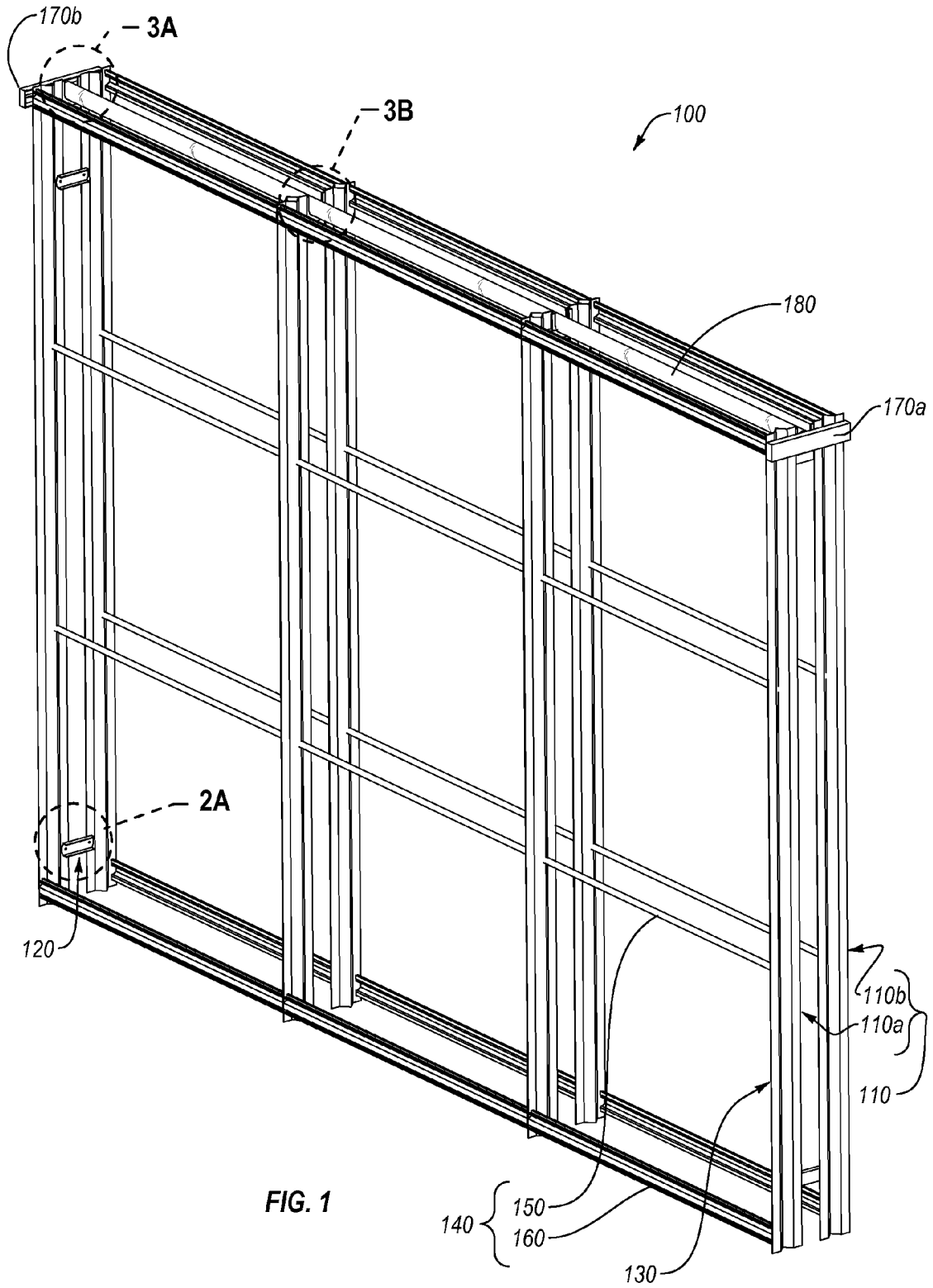
FIG. 1 illustrates a perspective view of a shiftable frame of a wall module in accordance with one implementation of the present invention.

FIG. 1 illustrates one implementations of a collapsible or shiftable frame 100 of an exemplary wall module. The wall module can comprise the shiftable frame 100 and one or more tiles or panels connected to the shiftable frame 100, as further described below. The shiftable frame 100 can have any number of suitable shapes, sizes, and configurations, which can vary from one implementation to another. Furthermore, the shiftable frame 100 and the wall module can connect to other frames and wall modules to form various modular walls, such as dividers, separator walls, partitions, etc.

For instance, the wall module that includes the shiftable frame 100 as well as other wall modules and similar structures can connect together to form individual spaces of various shapes, sizes, and configurations, as may be desired for a particular application. Such individual spaces include but are not limited to hallways, offices, kitchens, conference rooms, cubicles, and other rooms. Moreover, the installer can detach the wall modules that form various individual spaces and reconnect the same and/or different (e.g., additional) wall modules to form reconfigured spaces.

The shiftable frame 100 (and consequently the wall module) can include multiple frame sections 110 that can move relative to each other. For instance, the shiftable frame 100 can include a first frame section 110*a* and a second, opposing frame section 110*b*. In one implementation, one or more brackets 120 can connect the frame sections 110*a* and 110*b* together. Particularly, on a first end, the brackets 120 can fasten to the frame section 110*a*, and on a second end, the brackets 120 can fasten to the frame section 110*b*, thereby connecting the frame section 110*a* to the frame section 110*b*.

Moreover, in at least one implementation, the first and/or second ends of the brackets 120 can rotatably or pivotally connect to the respective frame sections 110*a*, 110*b*. In other words, the brackets 120 can pivot relative to either or both the frame section 110*a* and frame section 110*b*. Hence, as further described below, the brackets 120 can (at least under some conditions) allow the frame sections 110 connected thereby to move relative to each other, which can reduce or eliminate damage to the shiftable frame 100 and to the wall module during a seismic event.

Each of the frame sections 110 can include vertical supports 130 and horizontal supports 140 that can connect to the vertical supports 130. It should be appreciated that the specific number of the vertical supports 130 and/or horizontal supports 140 can vary from one implementation to the next. For example, in one implementation, each of the frame sections 110 can include four vertical supports 130 and four horizontal supports 140. Furthermore, in some instances, each of the frame sections 110 can include the same number of the vertical supports 130 and horizontal supports 140. Alternatively, however, the frame sections 110 can have different numbers of the vertical supports 130 and/or of the horizontal supports 140.

Moreover, the horizontal supports 140 can include one or more torsion bars 150 and/or one or more stringers 160. The torsion bars 150 can fixedly connect to the vertical supports 130 in a manner that prevents or limits relative rotation or twisting of the adjacent vertical supports 130. As such, the vertical supports 130 of a particular frame sections 110 can remain substantially stationary relative to one another, while the vertical supports 130 of different (e.g., adjacent) frame sections 110 can move relative to each other (via rotation or pivoting of the brackets 120).

As noted, the horizontal supports 140 also can include the stringers 160, which may connect to the vertical supports 130. As described in further detail below, the stringers 160 can include one or more protrusions that can secure panels to the frame sections 110 and to the shiftable frame 100. Accordingly, the shiftable frame 100 can include any suitable number of stringers 160, which may have any number of suitable positions and orientations for securing one or more panels to the shiftable frame 100. In any event, the vertical supports 130 and horizontal supports 140 can form the structural shell of the frame sections 110, which can be substantially rigid, such that the horizontal supports 140 and vertical supports 130 remain substantially stationary relative to one another.

An installer can secure the bottom end of any and/or all of the frame sections 110 to a floor or similar support structure. Similarly, the top end of any and/or all of the frame sections 110 can connect to the ceiling. In alternative implementations, the shiftable frame 100 as well as the wall module can be partially connected, such that only one of the top and bottom ends is secured to a support structure.

Also, FIG. 1 illustrates a full-height shiftable frame 100, which can form a full-height wall module (i.e., the shiftable frame 100 can span approximately from the floor to the ceiling). In other implementations, the shiftable frame 100 can be converted to a partial-height frame, which can form a partial-height wall module that extends only a portion of the distance between the floor and the ceiling. For example, the frame (or each of the frame sections) can include an upper frame portion and a lower frame portion.

In some instances, a spline can couple the upper and lower portions together along the vertical supports of the frame. Hence, to reconfigure the wall module from a full-height to a partial-height wall module, the installer can remove or reposition the spline along the vertical supports of the lower portion, thereby releasing the upper portion from the lower portion. Subsequently, the installer can remove the upper portion from the lower portion.

Implementations also can include the frame sections 110 that can be spaced from one another in a manner that forms an interior space or gap therebetween. A manufacturer can vary the space or gap between the frame sections 110 to increase or decrease the thickness of the wall. One will appreciate in light of the disclosure herein that the space between the frame sections 110 can allow a manufacturer to house or conceal various components. For example, the space can house or conceal HVAC equipment, plumbing equipment, electrical wires, etc. Alternatively, a manufacturer or installer can provide a thicker wall for aesthetic purposes.

As mentioned above, the frame sections 110 can move relative to one another (e.g., as the brackets 120 pivot). In one or more implementations, the connection between the brackets 120 and the frame sections 110 can at least partially restrain relative movement of the frame sections 110. In other words, the brackets 120 can allow the frame sections 110 to move relative to one another only upon application of a predetermined minimum amount of force. Accordingly, in some instances, under normal operating conditions (e.g., in the absence of a seismic event) the frame sections 110 can remain stationary relative to each other.

As mentioned above, the shiftable frame 100 can connect to the floor and remain unconnected from the ceiling. In some implementations, the shiftable frame 100 can be partially connected to the ceiling, such that shiftable frame 100 is restrained from movement relative to the ceiling under normal operating conditions and can move relative to ceiling during a seismic event. For instance, the shiftable frame 100 can include one or more knuckle brackets, such as knuckle brackets 170*a*, 170*b* connected to support structures (e.g., modular walls, permanent walls, ceiling, etc.) and a connector rod 180 secured therebetween. The connector rod 180 can span the length of the shiftable frame 100 and can limit lateral movement thereof.

As further described below, in some implementations, the shiftable frame 100 can include one or more cutouts or yokes that can accommodate the connector rod 180 therein. In one or more implementations, the connector rod 180 can have a tight sliding fit with the yokes. Accordingly, the yokes can operably connect with the connector rod 180 in a manner that the connector rod 180 restrains the frame sections 110 and the frame 100 from lateral movement (i.e., movement orthogonal to the connector rod 180). The connector rod 180 can allow movement or rotation of the yokes together with the frame sections about the rod 180. In other words, the frame sections 110 can move vertically relative to each other, as such movement of the frame sections 110 can produce movement of the yokes about the connector rod 180, as described in further detail below.

Additionally, as noted above, the knuckle brackets 170*a*, 170*b* can connect to different support structures, such as opposing walls. Rotatable connection of the knuckle brackets 170*a*, 170*b* with the connector rod 180 can allow the knuckle brackets 170*a*, 170*b* to move independently of one another. That is, any of the knuckle brackets 170*a*, 170*b* can spherically rotate relative to the connector rod 180 and can be restrained from lateral movement relative thereto. Consequently, the connector rod 180 and the knuckle brackets 170*a*, 170*b* may remain undamaged during or after relative movement of the structures securing the knuckle brackets 170*a*, 170*b*.

Figure 2A:
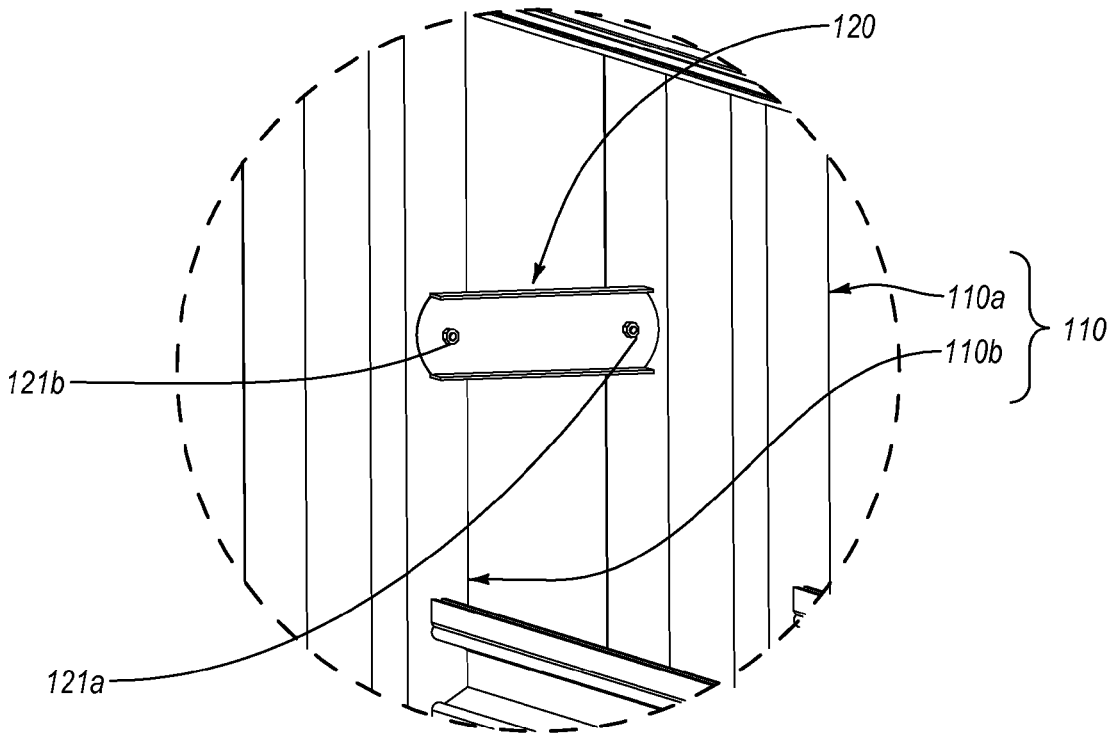
FIG. 2A illustrates an enlarged partial view of the shiftable frame of FIG. 1.

As described above, the brackets 120 can connect together two or more frame sections 110. FIG. 2A illustrates an exemplary connection between the bracket 120 and the respective frame sections 110. More specifically, as shown in FIG. 2A, the bracket 120 can connect to the frame section 110*a* at a first pivot point 121*a* and can connect to the frame section 110*b* at a second pivot point 121*b*. Hence, the frame section 110*a* and the bracket 120 can pivot relative to each other about the pivot point 121*a*, and the frame section 110*b* and the bracket 120 can pivot relative to each other about the pivot point 121*b*. Accordingly, as the frame section 110*a* and frame section 110*b* pivot relative to the bracket 120, the frame sections 110*a* and 110*b* can move vertically relative to each other.

Furthermore, the brackets 120 can limit lateral movement of the frame sections 110*a* and 110*b* (i.e., can limit the frame sections 110*a* and 110*b* from moving away or towards one another). As such, the bracket 120 can substantially limit movement of the frame sections 110 to a single degree of freedom, where the frame sections 110 can move approximately linearly relative to each other. Thus, the shiftable frame 100 (FIG. 1) and the wall module can maintain an approximately constant thickness during a seismic event, while having limited movement of the frame sections 110, which can minimize or avoid damaging the frame, the wall module, and/or surrounding structures.

In some instances, the frame may have an adjustable width. For example, the frame can include a bracket 120*a*, illustrated in FIG. 2B, which can allow the installer to selectively locate the frame section 110*a* and the frame section 110*b* relative to each other. Specifically, the bracket 120*a* can include a hole 122*a* and a slot 123*a* therethrough. In one implementation, the installer can pass a fastener through the hole 122*a*, which can pivotally connect the bracket 120*a* to one of the frame sections (e.g., the frame section 110*a*). The installer also can pass another fastener through the slot 123*a*, which can connect the bracket 120*a* to the other frame section (e.g., the frame section 110*b*). Moreover, the installer can position the fastener along the slot 123*a*, which can define the distance between the first and second pivot points as well as between the frame sections 110*a*, 110*b*.

In one or more implementations, the installer can preset the force required to move the sections of the frame by tightening the fasteners connecting the bracket to the sections of the frame. In particular, at a predetermined torque setting, the fasteners can press the bracket against the sections of the frame with a predetermined force. Accordingly, the frictional force between the bracket and the section of the frame (which is in part determined by the compressive force applied to press together the bracket and the section) can determine the force required to pivot the section relative to the bracket. Thus, the bracket can connect to the sections in a manner that under normal operating conditions or in the absence of a seismic event, the bracket and the section of the frame can remain substantially stationary relative to each other.

Figure 2B:
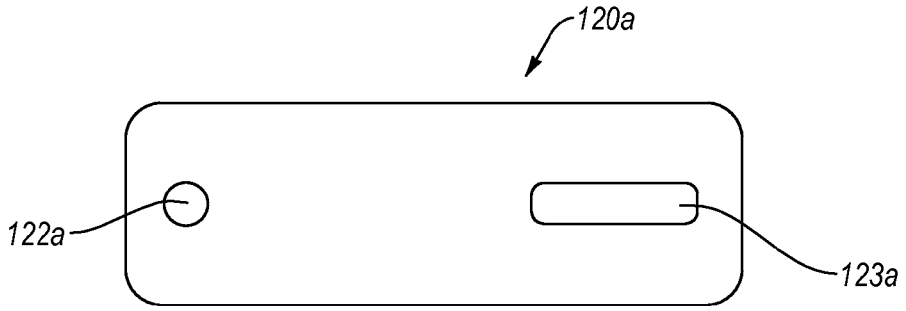
FIG. 2B illustrates a plan view of a bracket for connecting frame sections in accordance with one implementation of the present invention.

Furthermore, in some implementations, the slot 123*a* can allow the second section to pivot as well as slide relative to the brackets 120*a*, as the fastener rotates and/or slides within the slot 123*a*. Accordingly, in at least one implementation, sections of the frame can have limited lateral movement relative to each other. In addition, the frame can include any number of brackets, some or all of which can be similar to or the same as the bracket 120 (FIG. 2A). Likewise, some or all of the brackets can be similar to or the same as the bracket 120*a* (FIG. 2B). Hence, the entire or one or more portions of the section can move laterally and pivotally relative to another section connected by the brackets. In any event, the first and second sections can move relative to each other, thereby reducing or avoiding damage thereto during a seismic event.

Figure 3B:
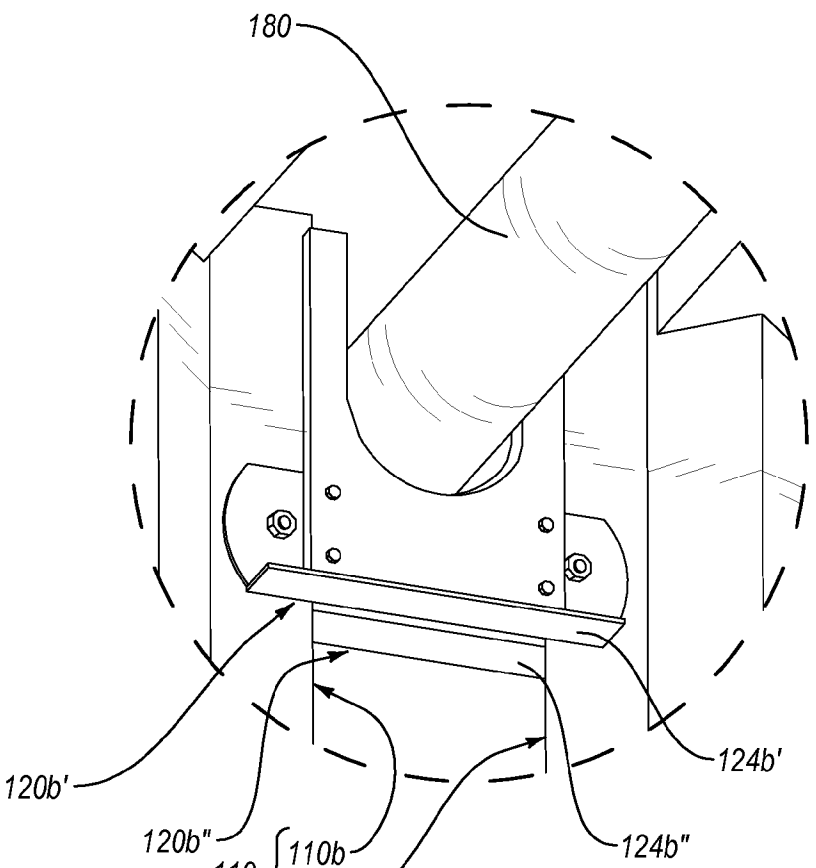
FIG. 3B illustrates yet another enlarged partial view of the shiftable frame of FIG. 1.
Figure 3A:
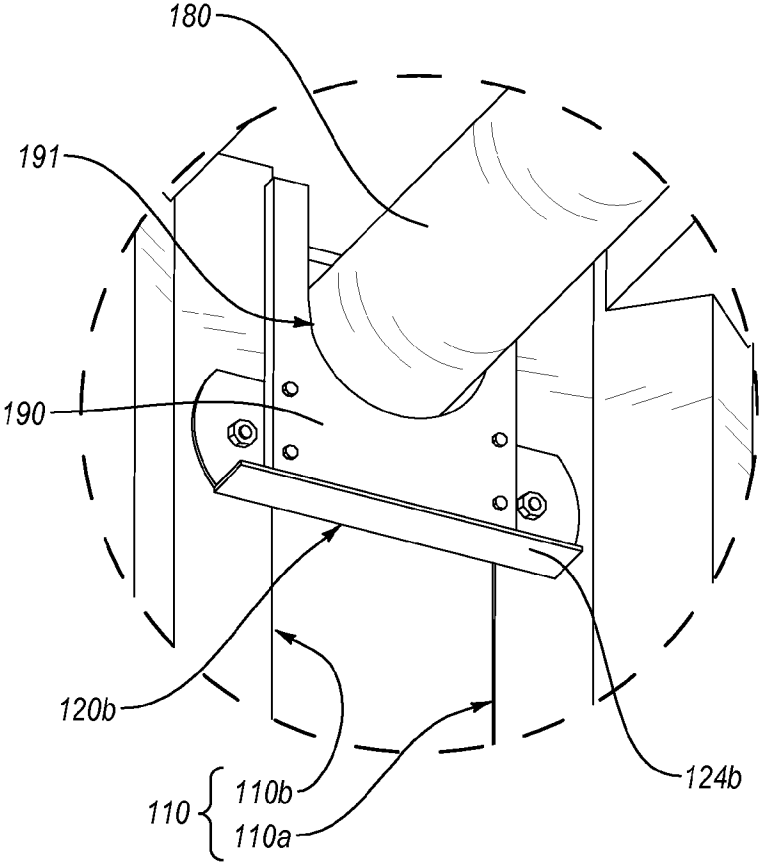
FIG. 3A illustrates another enlarged partial view of the shiftable frame of FIG. 1.

Implementations also can include a bracket that has a supporting ledge, which can support and/or locate other elements or components thereon. For example, FIGS. 3A-3B illustrates bracket 120*b* and bracket 120*b*', bracket 120*b*" respectively, which include respective supporting ledges 124*b* and 124*b*', 124*b*". As illustrated in FIG. 3A, the ledge 124*b* can support and/or locate a yoke 190 thereon. The yoke 190 can fit about the connector rod 180 in a manner that allows the yoke 190 to rotate about the connector rod 180 as the frame sections 110*a* and 110*b* shift or move vertically relative to each other.

Also, the fit between the connector rod 180 and the yoke 190 can limit lateral movement of the frame sections 110*a*, 110*b* relative to each other. Particularly, the yoke 190 can connect to the bracket 120*b*, which in turn can pivotally connect to the frame sections 110*b*, 110*a*. Accordingly, the bracket 120*b* together with the yoke 190 can pivot about the connector rod 180 as the frame sections 110*a* and 110*b* move vertically relative to each other. In any case, the yoke 190 can include a cutout or opening 191, which can have a shape (e.g., a curved shape) that allows the yoke 190 to rotate or pivot about the connector rod 180, while the frame sections 110*a*, 110*b* move vertically.

In some instances, the frame sections 110*a* and/or frame sections 110*b* can include multiple vertical members connected together by brackets. For instance, FIG. 3B illustrates bracket 120*b*' and bracket 120*b*" that can connect adjacent vertical members of the frame sections 110*a* and the frame sections 110*b*. Similar to the bracket 120*b* (FIG. 3A), the bracket 120*b*' and the bracket 120*b*" can have respective ledges 124*b*', 124*b*", which can locate (vertically) and support the yokes. Additionally, the installer can fasten the yokes to the bracket 120*b*' and/or the bracket 120*b*" with one or more fasteners.

In at least one example, the bracket 120*b*' can fasten to the bracket 120*b*". In particular, fasteners can pass through portions of the frame sections 110*a*, 110*b*, thereby connecting the bracket 120*b*', the bracket 120*b*", and respective frame sections 110*a*, 110*b* together. In one or more implementations, the yoke supported by the ledge 124*b*' can be fastened to the yoke supported by the ledge 124*b*" (not visible). In any event, connecting together the bracket 120*b*' and the opposing bracket 120*b*" and/or the opposing yokes positioned on the ledges 124*b*', 124*b*" can connect together adjacent vertical supports of each of the frame sections 110.

Figure 3C:
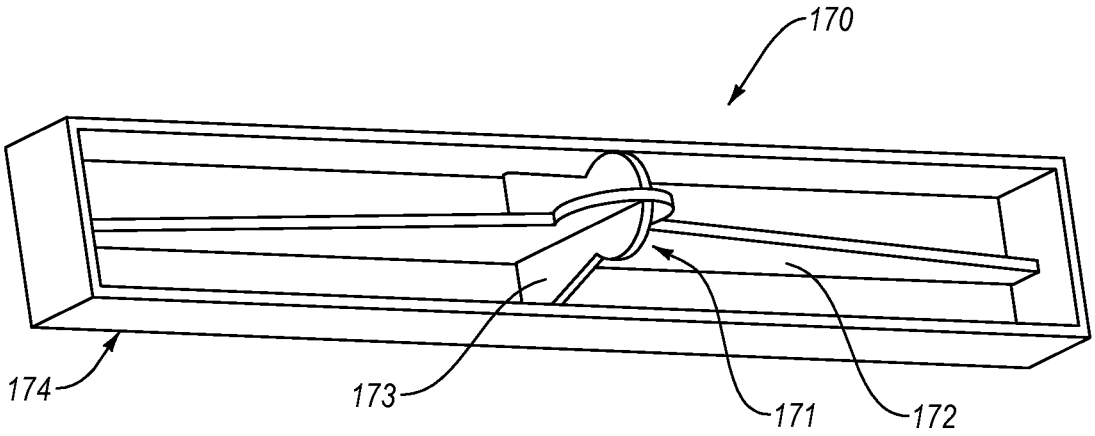
FIG. 3C illustrates a perspective view of a knuckle bracket for connecting a connection rod in accordance with one implementation of the present invention.

As described above, the connector rod 180 can fit over knuckle brackets, which can be secured to opposing support structures. FIG. 3C illustrates one implementation of the knuckle bracket 170 that can secure the connector rod. In particular, the knuckle bracket 170 can include an at least partially spherical protrusion 171 that can enter and be secured in an opening in the connector rod. For instance, the protrusion 171 can approximate an imaginary sphere, which can fit into the opening in the connector rod.

Implementations can include a connector rod that has an approximately round opening (e.g., a tubular connector rod, a solid connector rod with a circular blind hole, etc.). In one example, the protrusion 171 can enter the round opening of the connector rod in a manner that allows the protrusion 171 to rotate within the opening. Consequently, the knuckle bracket 170 can rotate relative to the connector rod and about the partially spherical shape of the protrusion 171, in a manner described above. In some implementations, the protrusion 171 and the hole in the connector rod can have a tight fit, which may require a predetermined amount of force to rotate the knuckle bracket 170 relative to the connector rod.

In at least one implementation, the knuckle bracket 170 can include ribs 172, 173, which can provide structural rigidity to the knuckle bracket 170 as well as form or define the protrusion 171. As such, the protrusion 171 can have four sections or segments that form the approximately spherical shape of the protrusion 171. In addition, the ribs 172 and/or 173 can span along the respective length and width of the knuckle bracket 170 and can prevent or limit twisting and/or bending of the knuckle bracket 170.

More specifically, in one example, the knuckle bracket 170 can include a base portion 174, which can connect to the support structure. The protrusion 171 can protrude out of the base 174, such that the installer can insert the protrusion 171 into the hole in the connector rod. The ribs 172 and 173 can prevent or limit twisting and/or bending of the base 174 as the opposing support structures move relative to each other together with the opposing knuckle bracket (and as the knuckle brackets rotate within the connector rod).

The knuckle bracket 170 can include any number of suitable materials, which can provide sufficient rigidity for the knuckle bracket 170. For instance, the knuckle bracket 170 can comprise steel, aluminum, plastics (e.g., reinforced plastic) as well as other materials and combinations thereof. In any case, the knuckle bracket 170 can have sufficient strength and rigidity to withstand seismic events as described above.

As mentioned above, the brackets also can allow the frame (and the wall module) to collapse, bringing the sections closer together. Collapsing the frame can allow the installer to position the frame in an upright position between a ceiling and a floor that have approximately the same distance therebetween as the height of the frame. It should be appreciated that, as illustrated in FIG. 4A, the installer may not be able to tilt a non-collapsible wall or wall module (of the same height as the collapsible frame or wall module) into an upright position in the same space.

Figure 4A:
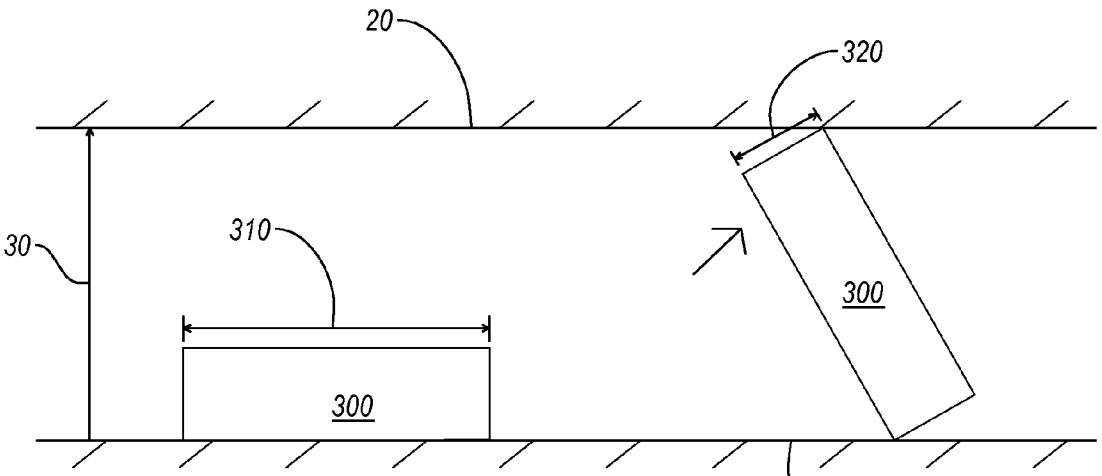
FIG. 4A illustrates a schematic representation of an installation process of a non-collapsible wall module.

Specifically, FIG. 4A illustrates a non-collapsible wall module 300 transitioning from a horizontal orientation to a vertical orientation. For instance, the installer can place the non-collapsible wall module 300 on the floor 10 and can subsequently tilt the non-collapsible wall module 300 toward an upright or vertical orientation. As shown in FIG. 4A, in some instances, the ceiling 20 can be at a distance 30 from the floor 10.

Moreover, the distance 30 can be similar to the height 310 of the non-collapsible wall module 300. Accordingly, the non-collapsible wall module 300 can have a width 320, which can prevent tilting of the non-collapsible wall module 300 into the upright position. Particularly, as the installer tilts the non-collapsible wall module 300 into the upright position, the upper portion of the non-collapsible wall module 300 can contact the ceiling 20 and can be prevented from further tilting or rotation thereby. In other words, the diagonal distance between the bottom edge on the first side and top edge on the opposite side is greater than the distance 30.

Figure 4B:
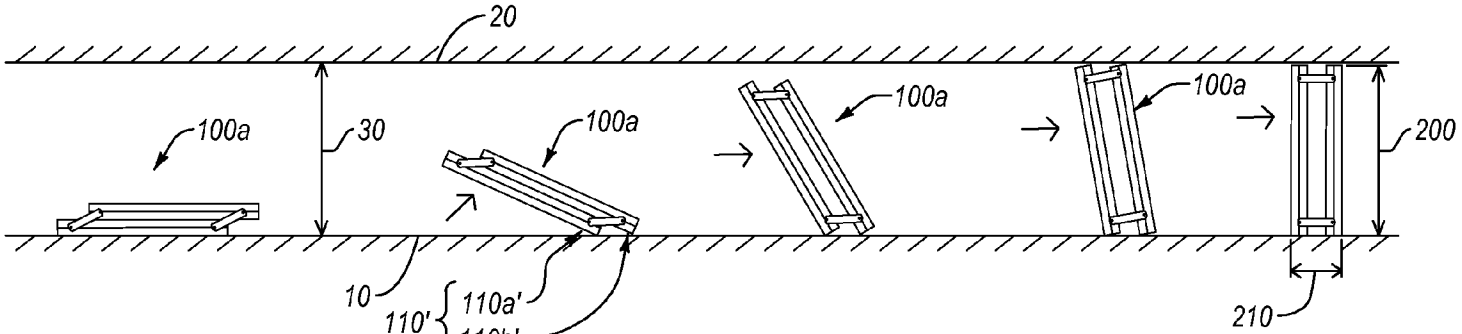
FIG. 4B illustrates a schematic representation of an installation process of a collapsible wall module in accordance with one implementation of the present invention.

Conversely, FIG. 4B illustrates an implementation of an installation method of a collapsible frame shiftable frame 100*a* of a wall module. In particular, the installer can raise the shiftable frame 100*a* into a vertical orientation as well as reconfigure the shiftable frame 100*a* from a collapsed configuration into an expanded configuration. In one or more implementations, the shiftable frame 100*a* and its materials, elements, or components can be similar to or the same as the shiftable frame 100 (FIG. 1) and its respective materials, elements, and components. Furthermore, the shiftable frame 100*a* can have an installed height 200 and installed width 210. The height 200 and width 210 of the shiftable frame 100*a* can be similar to or the same as the height 310 and width 320 of the non-collapsible wall module 300 (FIG. 4A).

Unlike the non-collapsible wall module 300 (FIG. 4A), however, collapsing and expanding the shiftable frame 100*a* can allow the installer to position the shiftable frame 100*a* in a vertical orientation between the floor 10 and ceiling 20. It should be appreciated that the floor 10 can be at the distance 30 from the ceiling 10 (similar to or the same as illustrated in FIG. 4A). In at least one implementation, the installer can place the shiftable frame 100*a* in a collapsed configuration on the floor 10. Subsequently, the installer can raise or tilt the shiftable frame 100*a* into the vertical orientation.

As described above, the shiftable frame 100*a* can include multiple frame sections 110' collapsibly connected together by one or more brackets. Hence, in some instances, as the installer tilts the shiftable frame 100*a*, one of the frame sections 110' can contact the floor 10 that, upon further tilting of the shiftable frame 100*a*, can force the frame sections 110' to move away from each other toward an expanded configuration. As such, titling the shiftable frame 100*a* into the vertical orientation can expand the shiftable frame 100*a* from the collapsed configuration into the expanded configuration (i.e., in which the shiftable frame 100*a* has the width 210).

Moreover, as shown in FIG. 4B, the ability to collapse and expand the shiftable frame 100*a* can allow the installer to raise the wall module as a single unit. In some implementations, the installer can first raise the shiftable frame 100*a* and can subsequently attach one or more panels to the shiftable frame 100*a*, as described further below. After raising the frame, the installer can tighten the connections between the brackets and the frame sections 110', such that the frame sections 110' can remain substantially stationary relative to each other under normal operating conditions and may mover relative to each other during a seismic event. Also, in some instances, the installer can raise the shiftable frame 100*a* together with the panels, as a module.

Figure 5:
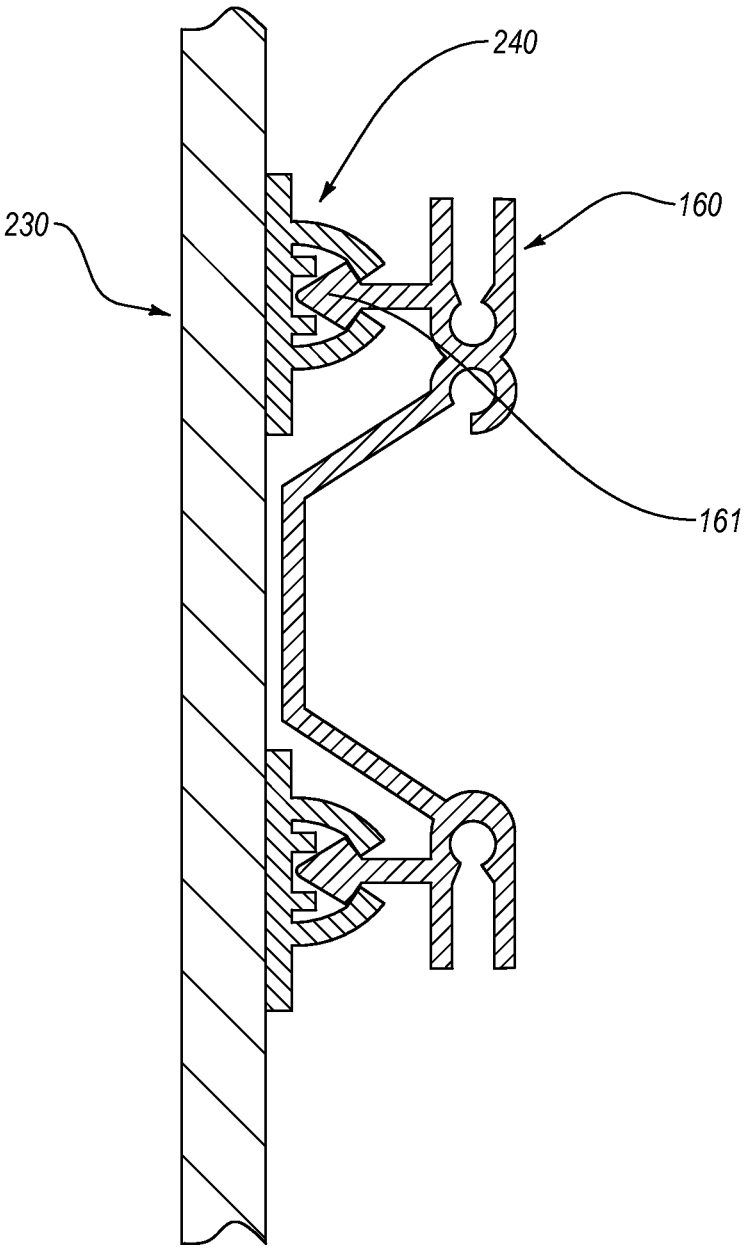
FIG. 5 illustrates a cross-sectional view of a panel connected to a stringer in accordance with one implementation of the present invention.

One should appreciate that any number of panels can connect to the frame in any suitable configuration, which can vary from one implementation to another. Furthermore, the panels can connect to the frame with any number of suitable connectors, which can form permanent, semi-permanent, and/or removable connections therebetween. For example FIG. 5 illustrates one implementation of a panel 230 connected to the stringer 160 of the frame.

Particularly, the stringer 160 can include various features or elements that can connect to or with corresponding features or elements of one or more panels. In one example, the stringer 160 can include one or more engagement protrusions 161. In one or more implementations, the engagement protrusions 161 comprise elongated members with a head connected to or integrated with the end of the elongated members.

For instance, the protrusions 161 can include an arrow-shaped head with undercutting portions. The panel 230 can include clips or connectors 240 that can have flexible arms that clip or snap about the head of engagement protrusions 161 to secure the panel 230 to the stringers 160. In particular, the flexible arms of the clips 240 can surround at least a portion of the head of the engagement protrusion 161.

In alternative or additional implementations, the panel 230 may not include clips 240. For instance, the panel 230 can connect directly to the stringers 160 with one or more fasteners, such as screws, bolts, etc. One will appreciate that the panel 230 can also attach to the vertical supports of the frame. For example, the vertical supports can include engagement protrusions (similar to the engagement protrusions 161) or other elements components that can secure the panel 230.

In any event, the stringer 160 can include features and/or elements that can removable secure or connect to corresponding features or elements of the panel 230. As such, the installer can attach the panels after positioning the frame in the upright or vertical configuration at the installation site. The installer also can remove the panel 230 from the frame to access the interior space of the frame as well as any number of components or elements housed within the interior space of the frame.

The stringers 160 can also optionally include one or more mounting holes. The mounting holes can accept fasteners or other connectors that can secure the stringers 160 to the vertical supports of the frame and vice versa. Alternatively or additionally, the stringers 160 can connect to the splines or other components or elements of the frame.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A shiftable frame for accommodating movement of structural portions of a building that secure the shiftable frame, the shiftable frame comprising:

a first frame section including a plurality of first vertical supports and one or more first horizontal supports;

a second frame section including a plurality of second vertical supports and one or more second horizontal supports;

one or more brackets, each of the one or more brackets having a first end thereof pivotally connected to the first frame section and a second end thereof pivotally connected to the second frame section;

a connector rod disposed between the first frame section and the second frame section and extending between opposing ends of the shiftable frame, wherein the connector rod limits lateral movement of the first frame section and the second frames section while allowing the first frame section and the section frame section to move vertically relative to one another and relative to the connector rod; and one or more knuckle brackets movably connected to the connector rod, the one or more knuckle brackets being connectable to one or more support structures or other shiftable frames, wherein the movable connection between the one or more knuckle brackets and the connector rod enables the one or more knuckle brackets and the connector rod to move independent of one another.

2. A shiftable frame as recited in claim 1, wherein the first frame section at least partially defines a first side of a wall module and the second frame section at least partially defines an opposing second side of the wall module.

3. A shiftable frame as recited in claim 1, wherein the one or more first horizontal supports comprise one or more stringers.

4. A shiftable frame as recited in claim 3, wherein the one or more stringers comprise the connection features.

5. A shiftable frame as recited in claim 1, wherein the one or more first horizontal supports comprise one or more torsion bars connected between the adjacent vertical supports of the plurality of first vertical supports.

6. A shiftable frame as recited in claim 1, wherein the shiftable frame is selectively reconfigurable between a collapsed configuration and an expanded configuration.

7. A shiftable frame as recited in claim 1, further comprising one or more yokes connected between the first frame section and the second frame section, wherein the one or more yokes are configured to rotate upon relative movement between the first frame section and the second frame section.

8. A shiftable frame as recited in claim 1, further comprising one or more fasteners that connect the one or more brackets to the first and second frame sections of the shiftable frame, wherein one or more of the first frame section and the second frame section includes connection features connectable to corresponding features of a panel, and wherein the one or more fasteners press the one or more brackets against the first and second frame sections with a frictional force that restrains relative movement between the first and second frame sections, such that the frictional force between the brackets and the first and second frame sections dictates the amount force required to pivot the first and second frame sections relative to the brackets.

9. A shiftable frame as recited in claim 7, wherein the connector rod is disposed at least partially within the one or more yokes to limit lateral movement of the shiftable frame.

10. A shiftable frame as recited in claim 1, wherein each of the one or more knuckle brackets includes a protrusion having an approximately spherical shape.

11. A shiftable wall module for at least partially defining one or more individual spaces within a building, the shiftable wall module comprising:

a first frame section including a first vertical support and a first stringer;

a second frame section including a second vertical support;

a bracket pivotally connected to the first vertical support and the second vertical support in a manner that the first frame section and the second frame section are movable relative to each other;

at least one panel removably connected to the stringer;

one or more yokes connected between the first frame section and the second frame section, each of the one or more yokes having an opening or cutout, wherein the one or more yokes are configured to rotate upon relative movement between the first frame section and the second frame section;

a connector rod disposed between the first frame section and the second frame section and extending between opposing ends of the shiftable frame, the connector being disposed within the opening or cutout of the one or more yokes, wherein the connector rod limits lateral movement of the first frame section and the second frames section while allowing for relative movement between the first frame section and the section frame section; and one or more knuckle brackets movably connected to the connector rod, the one or more knuckle brackets being connectable to one or more support structures or other shiftable frames, wherein the movable connection between the one or more knuckle brackets and the connector rod enables the one or more knuckle brackets and the connector rod to move independent of one another.

12. A shiftable wall module as recited in claim 11, wherein the bracket comprises a hole and a slot therethrough.

13. A shiftable wall module as recited in claim 12, wherein the bracket is pivotally connected to the first frame section via the hole.

14. A shiftable wall module as recited in claim 12, wherein the bracket is pivotally connected to the second frame section via the slot.

15. A shiftable wall module as recited in claim 14, wherein the second frame second is connectable to the bracket at multiple positions along the length of the slot to adjust the distance between the first frame section and the second frame section.

16. A shiftable wall module as recited in claim 11, wherein the at least one panel comprises (i) one or more panels removably connected to the first frame section to at least partially define a first side of the shiftable wall module, and (ii) one or more panels removably connected to the second frame section to at least partially define an opposing second side of the shiftable wall module.

17. A method of installing a wall module in a building, the method comprising:

positioning a bottom end of a first frame section of a frame on a floor of the building;

tilting the frame toward an upright orientation;

pressing a second section of the frame against the floor, the second section being movably connected to the first section;

moving the second section in a direction generally parallel to the first section;

positioning the frame in the upright orientation securing a connector rod between the first frame section and the second frame section such that the connector rod extends between opposing ends of the wall module and such that the connector rod limits lateral movement of the first frame section and the second frames section while allowing the first frame section and the section frame section to move vertically relative to one another and relative to the connector rod; and securing one or more knuckle brackets between the connector rod and one or more support structures or other wall modules, wherein the one or more knuckle brackets and the connector rod are movably secured together to enable the one or more knuckle brackets and the connector rod to move independent of one another.

18. The method as recited in claim 17, wherein moving the second frame section in a direction generally parallel to the first frame section results in the first frame section and the second frame section moving away from one another.

19. The method as recited in claim 17, further comprising securing the frame to a support structure.

20. The method as recited in claim 17, further comprising securing one or more panels to the frame.

* * * * *